US009644827B2

(12) United States Patent
Chien et al.

(10) Patent No.: US 9,644,827 B2
(45) Date of Patent: May 9, 2017

(54) LIGHT-EMITTING TIP FOR A CRUTCH

(71) Applicants: Li-Sheng Chien, Taipei (TW); Chien-Chang Ho, Taipei (TW)

(72) Inventors: Li-Sheng Chien, Taipei (TW); Chien-Chang Ho, Taipei (TW)

( * ) Notice: Subject to any disclaimer, the term of this patent is extended or adjusted under 35 U.S.C. 154(b) by 60 days.

(21) Appl. No.: 14/807,039

(22) Filed: Jul. 23, 2015

(65) Prior Publication Data

US 2017/0023220 A1 Jan. 26, 2017

(51) Int. Cl.

| | |
|---|---|
| ***A45B 3/02*** | (2006.01) |
| ***F21V 23/04*** | (2006.01) |
| ***F21V 33/00*** | (2006.01) |
| ***A61H 3/02*** | (2006.01) |

(52) U.S. Cl.

CPC ..... *F21V 23/04* (2013.01); *A61H 3/02* (2013.01); *F21V 33/0064* (2013.01)

(58) Field of Classification Search

CPC .... A45B 3/02; A45B 3/04; A61H 3/02; F21V 33/0064

USPC ..... 362/102

See application file for complete search history.

(56) References Cited

U.S. PATENT DOCUMENTS 7,377,662 B1 * 5/2008 Bernstein ..... A45B 3/04 135/77

8,337,035 B2 * 12/2012 Lu ..... A45B 3/04 362/102

* cited by examiner

*Primary Examiner* — Karabi Guharay

(74) *Attorney, Agent, or Firm* — WPAT, P.C., Intellectual Property Attorneys; Anthony King; Kay Yang

(57) ABSTRACT

A light-emitting tip disposed at the bottom end of a crutch includes a sleeve fitted around the bottom end of the crutch; a sleeve holder coupled to the sleeve to receive the bottom end of the crutch; a base coupled to a bottom end of the sleeve holder to form a receiving space; at least one light-emitting component fixed to the base from above and disposed between the sleeve holder and the base to emit light continuously or flashes to give an alert or provide illumination to protect users against danger in darkness; and a control component coupled to the at least one light-emitting component to determine whether to turn on and turn off the at least one light-emitting component, wherein the bottom end of the sleeve holder is made of a transparent material penetrable by any light ray emitted from the at least one light-emitting component.

6 Claims, 4 Drawing Sheets

LIGHT-EMITTING TIP FOR A CRUTCH

FIELD OF THE INVENTION

The present invention relates to crutch tips and, more particularly, to a crutch tip capable of emitting light.

BACKGROUND OF THE INVENTION

A crutch (also known as a mobility aid) is an important tool for assisting the elderly, persons with an injured leg, the physically handicapped and mountaineers (hereinafter collectively referred to as the users) in standing and walking, mainly by providing support to the users to therefore lessen the burden borne by the users' legs.

Depending on how they operate, conventional crutches generally fall into two categories, namely forearm crutches (underpinned by the users' hands) and underarm crutches (underpinned by the users' armpits.) A grip is disposed at the top of the forearm crutch and held by the user's hand while the user is standing or walking. An axillary support is disposed at the top of the underarm crutch and underpinned by the user's armpit while the user is standing or walking.

The bottom ends of the conventional forearm crutches and underarm crutches each come in the form of a single leg or four legs. To reduce the ground reaction force exerted by the ground on the crutches in contact with the ground and provide an anti-skid function, the bottom ends of the crutches are usually fitted to crutch tips (typically made of rubber.) Since the crutch tips are resilient, the users holding and resting on the crutches in contact with the ground experience less vibration than they will when the crutch tips are not resilient. In addition, the crutch tips which are resilient can increase the friction between the ground and the bottom ends of the crutches and thus provide an anti-skid function.

However, in some circumstances, for example, at night or in dim surroundings, conventional crutches fail to give any alert or provide any illumination, and in consequence the users are exposed to danger.

SUMMARY OF THE INVENTION

It is an objective of the present invention to provide a light-emitting tip to be mounted on the bottom end of a crutch in order to give an alert or provide illumination to thereby protect the users against danger which might otherwise occur because of dim surroundings.

Another objective of the present invention is to provide a light-emitting tip placed under the control of a vibration-triggered switch or a touch-triggered switch to thereby give an alert or provide illumination as needed.

In order to achieve the above and other objectives, the present invention provides a light-emitting tip, disposed at a bottom end of a crutch, comprising: a sleeve fitted around the bottom end of the crutch; a sleeve holder coupled to the sleeve to receive the bottom end of the crutch; a base coupled to a bottom end of the sleeve holder; at least one light-emitting component fixed to the base from above and disposed between the sleeve holder and the base; and a control component coupled to the at least one light-emitting component to determine whether to turn on and turn off the at least one light-emitting component, wherein the bottom end of the sleeve holder is made of a transparent material penetrable by any light ray emitted from the at least one light-emitting component.

As regards the light-emitting tip, the sleeve and a coupling portion of the sleeve holder have an inner thread portion and an outer thread portion, respectively, in a manner that the inner thread portion and the outer thread portion correspond in position to each other such that the sleeve and the sleeve holder mesh with each other.

As regards the light-emitting tip, further comprises a fixing element whereby the sleeve holder is fixed to the base.

As regards the light-emitting tip, the control component is a touch-triggered switch for controlling the ON and OFF of the light-emitting component.

As regards the light-emitting tip, the control component is a vibration-triggered switch for controlling the ON and OFF of the light-emitting component.

In conclusion, the present invention provides a light-emitting tip disposed at a bottom end of a crutch. The light-emitting tip comprises a sleeve fitted around the bottom end of the crutch, a sleeve holder coupled to the sleeve to receive the bottom end of the crutch, a base coupled to a bottom end of the sleeve holder, and at least one light-emitting component disposed in a receiving space between the sleeve holder and the base. The at least one light-emitting component emits light continuously or flashes to give an alert or provide illumination to protect users against danger in dim surroundings.

BRIEF DESCRIPTION OF THE DRAWINGS

Objectives, features, and advantages of the present invention are hereunder illustrated with specific embodiments in conjunction with the accompanying drawings, in which.

DETAILED DESCRIPTION OF THE PREFERRED EMBODIMENTS

Figure 1:
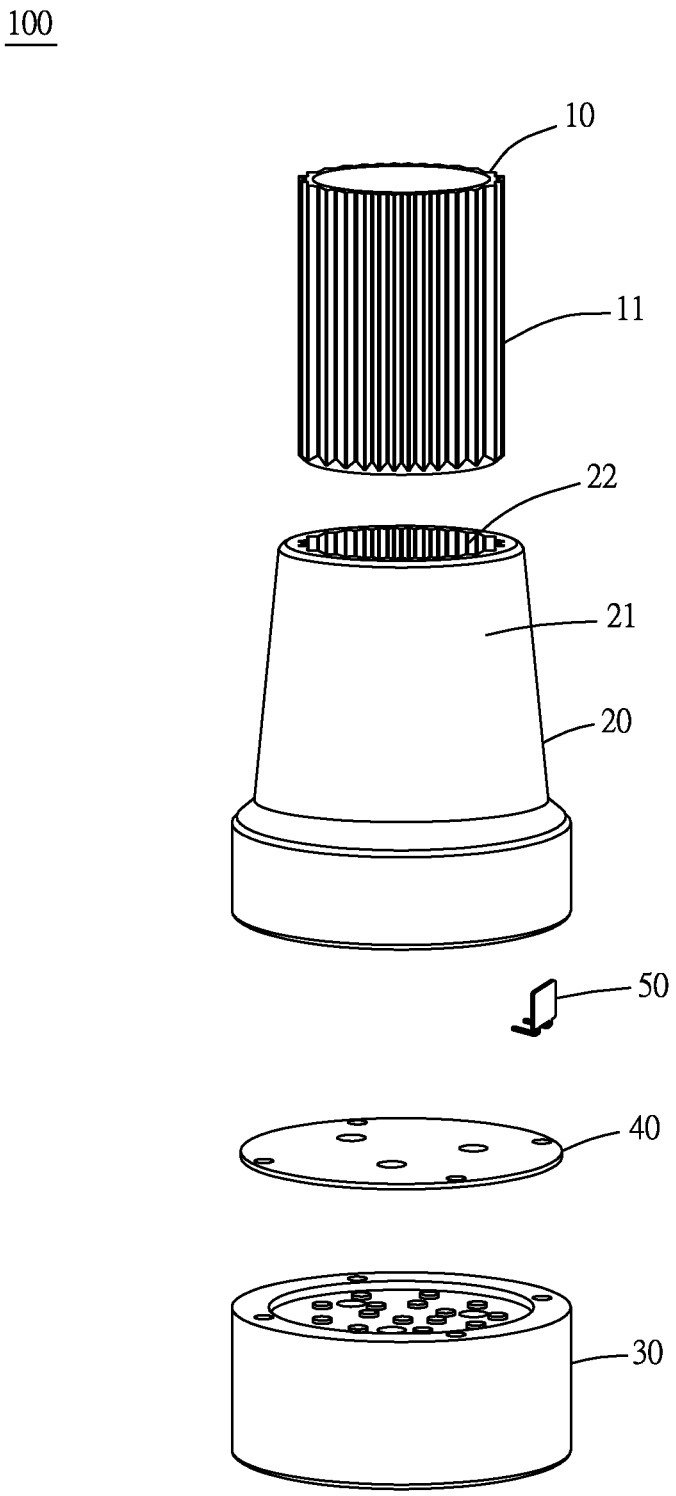
FIG. 1 is an exploded view of a light-emitting tip according to the first embodiment of the present invention.

Referring to FIG. 1, there is shown an exploded view of a light-emitting tip 100 according to the first embodiment of the present invention.

In this embodiment, the light-emitting tip 100 comprises a sleeve 10, a sleeve holder 20, a base 30, a light-emitting component 40, and a control component for controlling the light-emitting component 40.

The sleeve 10 is fitted around the bottom end of a crutch 200 by adhesion or tightening and thus the length, shape and coefficient of elasticity of the sleeve 10 are adjustable to allow the sleeve 10 to be firmly fitted around the bottom end of the crutch 200. Preferably, the sleeve 10 is resilient when made of rubber and thus capable of cushioning and reducing vibration.

The sleeve holder 20 fixes the sleeve 10 in place. The sleeve holder 20 has a coupling portion 21 whereby the sleeve holder 20 is coupled to the sleeve 10. The inner wall of the coupling portion 21 defines annularly a recess or tunnel for receiving the sleeve 10 and the bottom end of the crutch 200 such that the bottom end of the crutch 200 can be inserted into and fixed to the sleeve 10.

Furthermore, the sleeve 10 and the coupling portion 21 of the sleeve holder 20 have an inner thread portion 11 and an outer thread portion 22, respectively, in a manner that the inner thread portion 11 and the outer thread portion 22 correspond in position to each other to enable the sleeve 10 and the sleeve holder 20 to mesh with each other and thereby be fixed to the crutch 200, though the present invention is not limited thereto. Furthermore, the sleeve 10 and the inner thread portion 11 are made of a resilient material, but the sleeve holder 20 and the outer thread portion 22 are made of a rigid material; hence, the sleeve 10 and the sleeve holder 20 mesh with each other efficiently.

The base 30 and the bottom end of the sleeve holder 20 are coupled together in a manner to form therebetween a space for receiving any other components. In this embodiment, the bottom end of the sleeve holder 20 is cap-shaped to thereby define therein a hollow core coupled to the top of the base 30 and form therebetween the receiving space, but the present invention is not limited thereto. In addition, the base 30 is resilient when made of rubber to thereby increase the friction of the light-emitting tip 100 in operation.

The light-emitting component 40 is received in the receiving space. The light-emitting component 40 is capable of emitting light continuously or is put under the control of a circuit board (not shown) in flashing. The bottom end of the sleeve holder 20 is made of a transparent material penetrable by any light ray emitted from the light-emitting component 40.

In this embodiment, the control component is provided in the form of a touch-triggered switch 50 coupled to the light-emitting component 40 to determine whether to turn on or turn off the light-emitting component 40. For example, the touch-triggered switch 50 is a press-activated switch (such as a single-key alternately-triggered switch) or a touch-sensed switch.

In this embodiment, to mount the light-emitting tip 100 on the bottom end of the crutch 200, the users fixes the bottom end of the crutch 200 to the sleeve holder 20 through the sleeve 10. The length, shape and coefficient of elasticity of the sleeve 10 are design choices and depend on the crutch 200 in terms of category and design. Preferably, the sleeve 10 is resilient when made of rubber and thus capable of cushioning and reducing vibration. The light-emitting component 40 received in the space formed by the sleeve holder 20 and the base 30 emits light continuously or flashes to give an alert or provide illumination to thereby protect the users against danger which might otherwise occur because of dim surroundings. In addition, the users touch the touch-triggered switch 50 to determine whether to turn on or turn off the light-emitting component 40.

Figure 2:
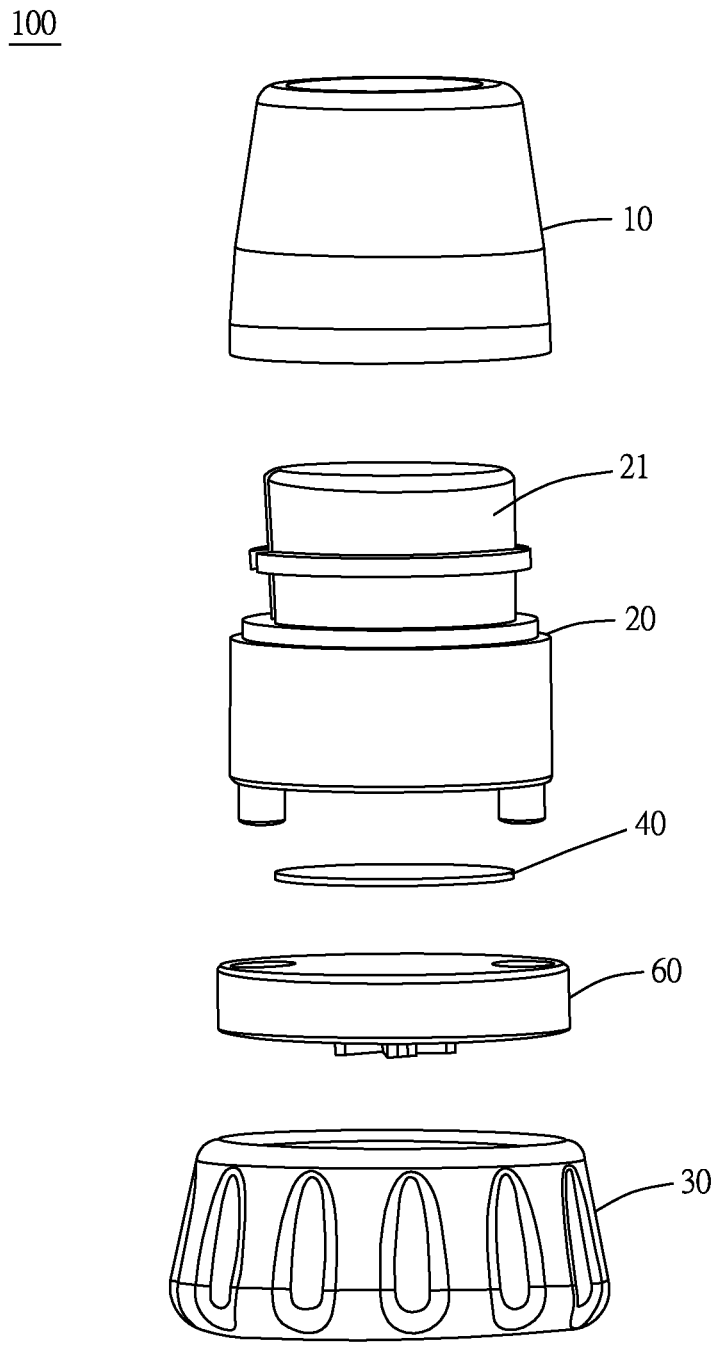
FIG. 2 is an exploded view of the light-emitting tip according to the second embodiment of the present invention.

Referring to FIG. 2, there is shown an exploded view of the light-emitting tip 100 according to the second embodiment of the present invention.

In the second embodiment, the light-emitting tip 100 comprises a sleeve 10, a sleeve holder 20, a base 30, a light-emitting component 40, and a control component for controlling the light-emitting component 40.

Although the second embodiment is different from the first embodiment in terms of the structures of the sleeve 10 and the sleeve holder 20, both the sleeve 10 and the sleeve holder 20 serve to fix the bottom end of the crutch 200 in place in both the first and second embodiments. In this regard, in addition to meshing, the sleeve 10 and the sleeve holder 20 of the second embodiment can be coupled together when the upper and lower ends of the sleeve 10 are fitted to the bottom end of the crutch 200 and the sleeve holder 20, respectively. To this end, the sleeve holder 20 is equipped with the coupling portion 21 whereby the bottom end of the crutch 200 is directly inserted into and fixed to the sleeve 10.

The second embodiment is different from the first embodiment in terms of the way of coupling the sleeve holder 20 and the base 30 together. In the second embodiment, the bottom end of the sleeve holder 20 is cylindrical, and the base 30 is annular so as to enclose the sleeve holder 20, such that the sleeve holder 20 and the base 30 is coupled together.

Furthermore, the light-emitting tip 100 comprises a fixing element 60 whereby the sleeve holder 20 is fixed to the base 30.

In this embodiment, the control component is a vibration-triggered switch (also known as vibration-triggered sensor, not shown) coupled to the light-emitting component 40 (and disposed in the base 30 and not shown in FIG. 2) to determine whether to turn on or turn off the light-emitting component 40. Likewise, the base 30 is coupled to the bottom end of the sleeve holder 20 in a manner to form therebetween a space for receiving any other related component. For instance, both the vibration-triggered switch and the light-emitting component are received in the space. In this embodiment, it is also feasible that both the vibration-triggered switch and the light-emitting component are disposed inside the base 30. The bottom end of the sleeve holder 20 is made of a transparent material penetrable by any light ray emitted from the light-emitting component 40.

To mount the light-emitting tip 100 on the crutch 200, the users insert the bottom end of the crutch 200 into the sleeve holder 20 until the bottom end of the crutch 200 is inserted into and fixed to the sleeve 10 (the length, shape and coefficient of elasticity of the sleeve 10 are design choices and depend on the crutch 200 in terms of category and design), so as to effect cushioning and reduction of vibration. In addition, in the situation where a user holding the crutch 200 walks and moves around, the vibration-triggered switch senses the user's movement and thus triggers the light-emitting component 40 to emit light continuously or flash in order to determine the best time for the light-emitting component 40 to start intermittently.

In addition, in this embodiment, it is also feasible for any other appropriate switch, such as a dip switch, to controllably turn on or turn off the light-emitting component.

Figure 3:
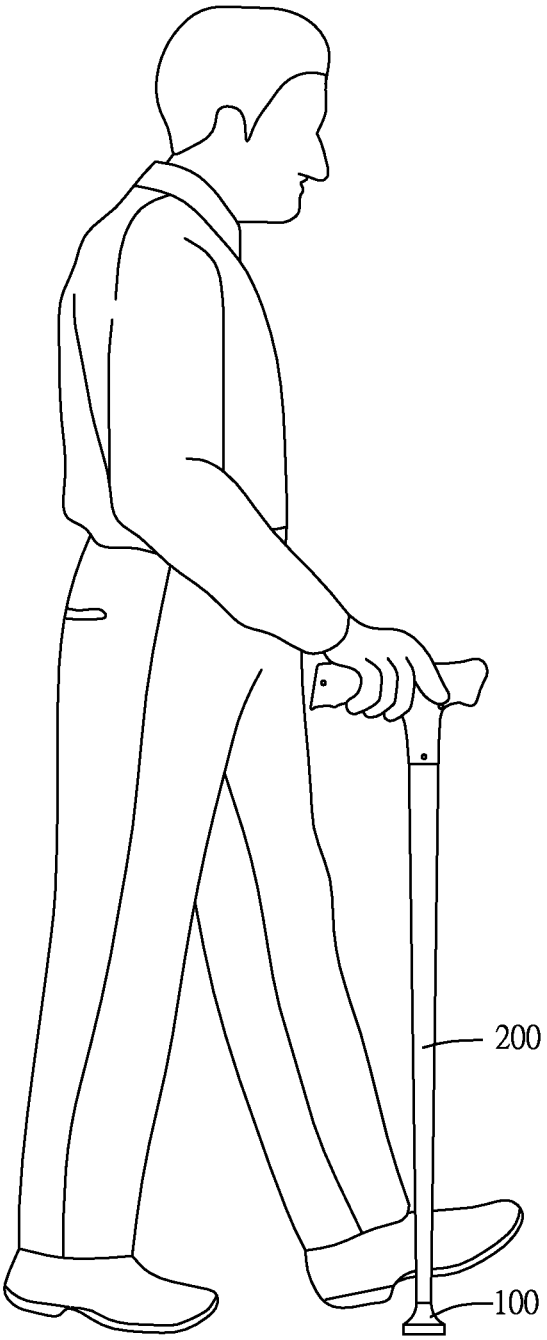
FIG. 3 is a perspective view of the light-emitting tip coupled to the bottom end of a crutch held by a user according to the present invention.
Figure 4:
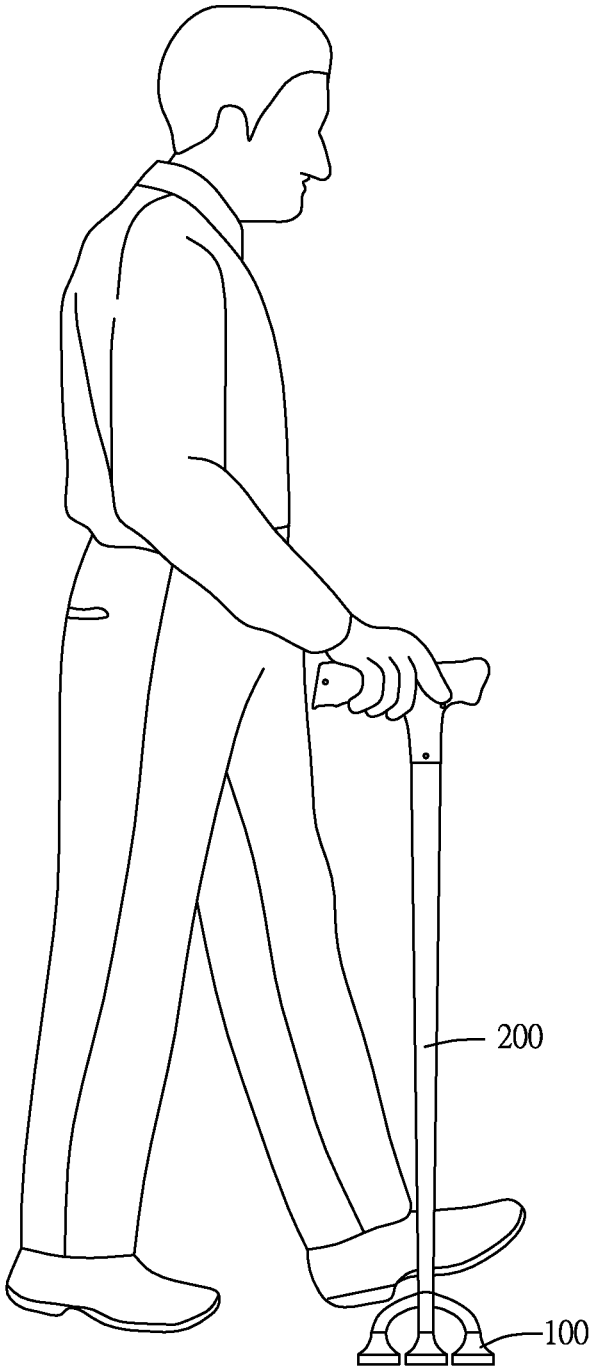
FIG. 4 is a perspective view of the light-emitting tip coupled to the bottom end of another crutch held by a user according to the present invention.

In addition, FIG. 3 and FIG. 4 are perspective views of the light-emitting tip 100 coupled to the bottom end of the crutch 200 provided in two different forms according to the present invention, respectively. As shown in the diagrams, the light-emitting tip 100 is applicable to the crutch 200 which comes in various forms according to the present invention.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. A light-emitting tip, disposed at a bottom end of a crutch, comprising:

a sleeve fitted around the bottom end of the crutch;

a sleeve holder coupled to the sleeve to receive the bottom end of the crutch;

a base coupled to a bottom end of the sleeve holder;

at least one light-emitting component fixed to the base from above and disposed between the sleeve holder and the base; and a control component coupled to the at least one light-emitting component to determine whether to turn on and turn off the at least one light-emitting component, wherein the bottom end of the sleeve holder is made of a transparent material penetrable by any light ray emitted from the at least one light-emitting component, wherein the sleeve and a coupling portion of the sleeve holder have an inner thread portion and an outer thread portion, respectively, in a manner that the inner thread portion and the outer thread portion correspond in position to each other such that the sleeve and the sleeve holder mesh with each other, wherein the sleeve and the inner thread portion are made of a resilient material, and the sleeve holder and the outer thread portion are made of a rigid material.

2. The light-emitting tip of claim 1, further comprising a fixing element whereby the sleeve holder is fixed to the base.

3. The light-emitting tip of claim 2, wherein the control component is a vibration-triggered switch for controlling the ON and OFF of the light-emitting component.

4. The light-emitting tip of claim 1, wherein the control component is a touch-triggered switch for controlling the ON and OFF of the light-emitting component.

5. The light-emitting tip of claim 1, wherein the control component is a touch-triggered switch for controlling the ON and OFF of the light-emitting component.

6. The light-emitting tip of claim 1, wherein the control component is a vibration-triggered switch for controlling the ON and OFF of the light-emitting component.

* * * * *